US006372418B1

(12) United States Patent
Gisser et al.

(10) Patent No.: US 6,372,418 B1
(45) Date of Patent: Apr. 16, 2002

(54) COLOR MOTION PICTURE PRINT FILM WITH IMPROVED TONESCALE

(75) Inventors: Kathleen R. C. Gisser, Pittsford; Esther M. Betancourt; Leslie Gutierrez, both of Rochester; Sandra M. Finn, Honeoye Falls; Susan K. Mroczek, Webster; Christopher J. Haller, Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/618,246

(22) Filed: Jul. 18, 2000

(51) Int. Cl.[7] ..... G03C 1/46

(52) U.S. Cl. ..... 430/505; 430/502; 430/503; 430/567; 430/383

(58) Field of Search ..... 430/505, 383, 430/567, 502, 503

(56) References Cited

U.S. PATENT DOCUMENTS

| | | | |
|---|---|---|---|
| 5,300,381 | A | 4/1994 | Buhr et al. |
| 5,390,036 | A | 2/1995 | Buhr et al. |
| 5,447,811 | A | 9/1995 | Buhr et al. |
| 5,514,527 | A | 5/1996 | Abe et al. |
| 5,528,339 | A | 6/1996 | Buhr et al. |
| 5,538,839 | A | 7/1996 | Abe et al. |
| 5,561,012 | A | 10/1996 | Brewer et al. |
| 5,576,128 | A | 11/1996 | Keech et al. |
| 5,674,665 | A | 10/1997 | Sawyer et al. |
| 5,705,327 | A | 1/1998 | Brewer et al. |
| 5,750,320 | A | 5/1998 | Bogdanowicz et al. |
| 5,888,706 | A | 3/1999 | Merrill et al. |
| 5,891,607 | A | 4/1999 | Brewer et al. |
| 5,985,529 | A | 11/1999 | Bogdanowicz et al. |
| 6,077,654 | A | 6/2000 | Merrill et al. |

OTHER PUBLICATIONS

American Cinematographer; Reflections: The Lab, Part II; by Benjamin Bergery; May 1993; pp. 74–78.

*Primary Examiner*—Geraldine Letscher
(74) *Attorney, Agent, or Firm*—Andrew J. Anderson

(57) ABSTRACT

A silver halide light sensitive photographic print element is disclosed comprising a support bearing on one side thereof: a blue color sensitive record comprising at least one blue-sensitive silver halide emulsion yellow-image forming layer, a red color sensitive record comprising at least one red-sensitive silver halide emulsion cyan-image forming layer, and a green color sensitive record comprising at least one green-sensitive silver halide emulsion magenta-image forming layer; wherein the overall contrast (OC) of the green record is greater than 1.7, the mid-scale contrast (MSC) of the green record is less than 2.6, and the upper-scale contrast (USC) of the green record is from 2.85 to 3.15, wherein the parameters OC, MSC and USC are as defined herein. Color print film silver halide photographic elements in accordance with the invention enable the production of outstanding projected images having improved flesh tone and shadow detail reproduction, and sufficiently high black densities.

19 Claims, 1 Drawing Sheet

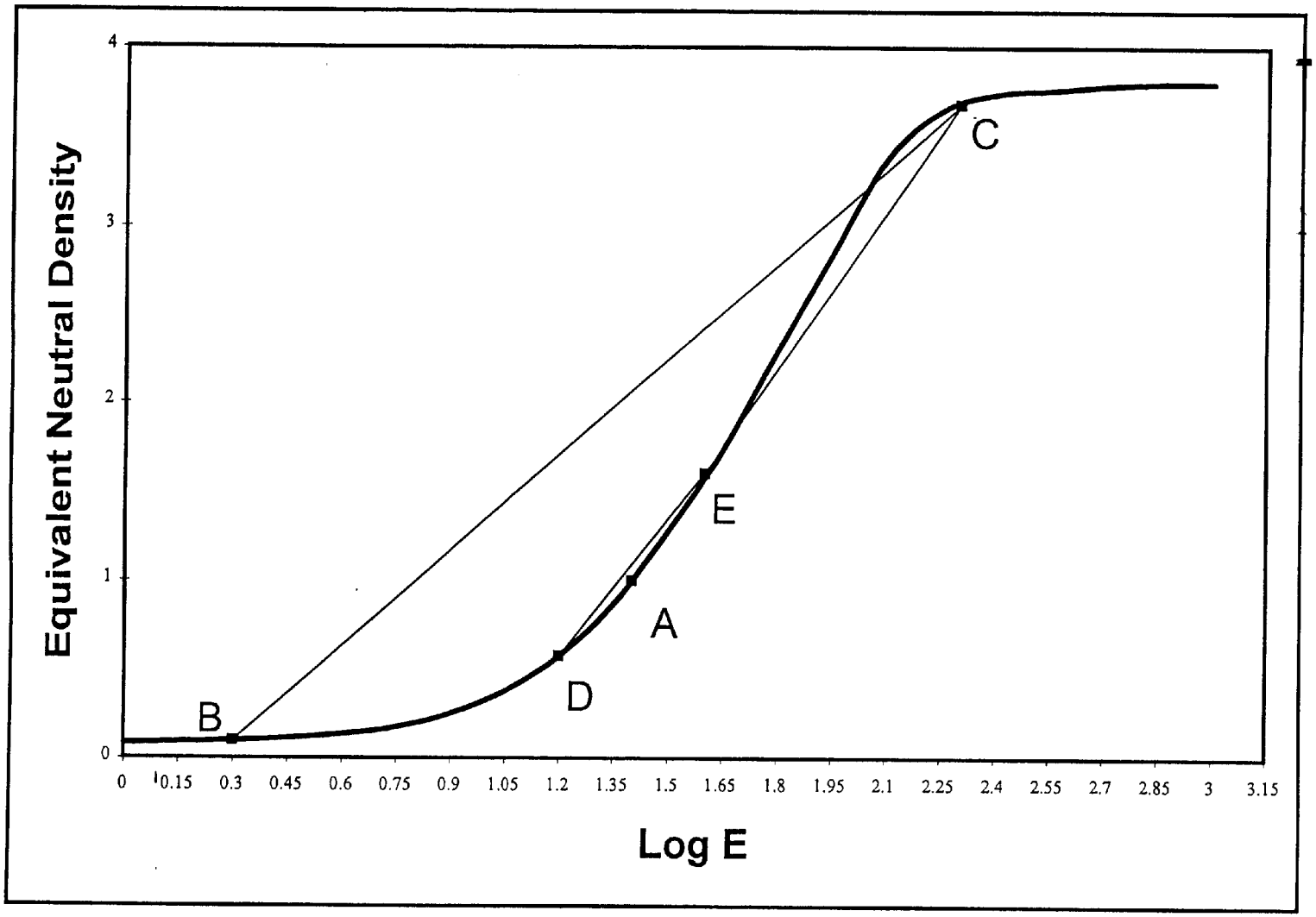
Equivalent Neutral Density
0
1
2
3
4
0
0.15
0.3
0.45
0.6
0.75
0.9
1.05
1.2
1.35
1.5
1.65
1.8
1.95
2.1
2.25
2.4
2.55
2.7
2.85
3
3.15
Log E
A
B
C
D
E

COLOR MOTION PICTURE PRINT FILM WITH IMPROVED TONESCALE

FIELD OF THE INVENTION

The invention relates to a color motion picture print silver halide photographic film, and more particularly to such a film which has an enhanced tonescale optimized for flesh tone and shadow detail reproductions.

BACKGROUND

Color negative origination silver halide photographic films are a class of photosensitive materials that map the luminance (neutral) and chrominance (color) information of a scene to complementary tonal and hue polarities in the negative film. Upon exposure and development of the film to form dye images from photographic couplers incorporated in the film, light areas of the scene are recorded as dark areas on the color negative film, and dark areas of the scene are recorded as light areas on the color negative film. Colored areas of the scene are typically recorded as complementary colors in the color negative film: red is recorded as cyan, green is recorded as magenta, blue is recorded as yellow, etc. In order to render an accurate reproduction of a scene, a subsequent process is necessary to reverse the luminance and chrominance information back to those of the original scene. In the motion picture industry, one such subsequent process is to optically print (by contact or optics) the color negative film onto another negative working photosensitive silver halide material which produces dye images upon exposure and development, such as a motion picture silver halide print film, to produce a color positive image suitable for projection.

Historically, color print silver halide photographic materials, such as EASTMAN EXR Color Print Film 5386®, have been optimized to yield pleasing projected prints when used in conjunction with color negative origination silver halide photographic materials as discussed above. That is, the sensitometric properties of print materials are co-optimized by considering the properties of the printing device to be used and the nature of a representative color negative tonescale to be printed, such as that of KODAK VISION 500T Color Negative Film $_{5279}$®. When a motion picture color negative is printed on motion picture color print stock, the sensitometric properties of the two materials combine to yield an acceptable scene reproduction in the print film when projected on a theater screen. To facilitate obtaining optimal reproductions, guidelines exist regarding the exposure of the camera original negative (for example see American Cinematographer Manual, Dr. Rod Ryan Ed., $7^{th}$ Edition, The ASC Press, Hollywood, Calif., 1993, pp128–141.), exposure of the print stock (LAD-*Laboratory Aim Density* KODAK Publication No. H-61), and projector/screen luminance levels (Society of Motion Picture and Television Engineers (SMPTE) Standard 196M–1995).

In order to obtain a high quality visual image in an optical photographic print, the contrasts for each color record of the negative film and print film designed for producing optical prints are typically maintained within certain ranges (e.g., mid-scale contrasts of about 0.45–0.7 for negative films and about 2.5–3.1 for print films). Higher contrasts generally result in less preferred flesh tone reproductions and loss of shadow detail. Lower contrasts may improve flesh tone reproductions, but also may result in production of flat-looking positive print images with black tones rendered as smokey-grey and white tones rendered as light gray. Pictures such as these would not be pleasing to view and would be deemed to be of low quality in the industry.

Correct exposure of camera negative originals has long been emphasized not only to ensure that critical scene information is properly recorded but also so that when the negative is printed on a photographic print film according to trade practice, scene blacks are sufficiently dense in the resulting projected prints. To provide sufficient black densities, the maximum equivalent neutral (i.e., visual) densities obtainable for a silver halide photographic print film should generally be at least about 3.3, and more preferably at least about 3.5, where the Equivalent Neutral Density of any particular dye color record is defined as the visual density that results when the other two dyes are added in quantities just sufficient to produce a neutral gray (see, e.g., "Procedures for Equivalent-Neutral-Density (END) Calibration of Color Densitometers Using a Digital Computer", by Albert J. Sant, in the Photographic Science and Engineering, Vol. 14, Number 5, September–October 1970, pg. 356).

Color photographic silver halide motion picture print films are typically optimized for the direct or release optical printing of color photographic silver halide negative films. Such motion picture silver halide photographic print stocks are accordingly designed with latitudes commensurate for use with typical color negative photographic film dynamic ranges, typically 1.5 printing density or less. The upper-scale contrast of most conventional photographic silver halide print stock is such that lighter densities on the recorded negative map to a region of decreasing contrast in the print stock, preventing the achievement of high print densities that may be desirable for improved reproduction of scene blacks. U.S. Pat. No. 5,888,706 discloses motion picture print films which have significantly higher upper-scale contrasts in combination with conventional midscale contrasts, which enables high black densities and improved color saturation, while also maintaining reasonable flesh tone and shadow-detail reproduction.

One solution available to photographers and cinematographers for improving flesh tone reproduction in a reproduced image is to lower the gamma of the color negative origination and/or print photosensitive materials. There are two currently available methods for lowering gamma. The first method of achieving lower overall gamma with silver halide based films is by reducing the development time and/or temperature outside the specifications provided by the manufacturer, a condition known as under-development. One way this is practiced in the art is to empirically plot gamma against development time. From the results, an appropriate development time is chosen. Gamma is calculated from a plot of density versus log E. This is described in The Manual of Photography by Ralph E. Jacobson, Focal Press, 1978. The second method to lower the gamma in the photosensitive materials is to alter the exposure protocol, specified by the manufacturer, with a technique called "flashing." With this technique, a film is exposed to a weak, but uniform, level of light prior to development. The exposure can be applied either before or after exposure to record the desired image. The level of light that must be used is determined by an empirical, trial-and error procedure. This is described in American Cinematographer Manual, 6th edition, The ASC Press, 1986 and in Motion Picture Film Processing by Dominic Case, Focal Press, 1985. Neither of these strategies, however, will fully maintain desired blacks and whites reproduction from the original scene to the viewed image.

U.S. Pat. No. 5,674,665 discloses a relatively low contrast color negative origination photosensitive material which provides the ability to record original scenes and create viewed images with a large range of subject luminance and low contrast, and with blacks and whites from the original scene reproduced faithfully, without the need for special exposing and/or processing conditions. Not all scenes are captured on origination film having such characteristics, however, and such advantages are accordingly not available when printing a scene recorded on other negative film stocks onto available motion picture print films.

It would be desirable to provide motion picture print films which enable improved flesh tone reproduction and image shadow detail, while maintaining sufficiently high black densities in projected prints. The overall contrast of color-coupled silver halide photographic print materials may be lowered to improved flesh tone reproductions by either changing film silver laydown and/or coupler levels or through modification of film processing conditions. Unfortunately, in doing so, the maximum densities in such lower contrast films would also be undesirably lowered upon conventional printing as discussed above. Thus there is an apparent conflict in establishing an optimal contrast level for photographic print stock: to obtain improved flesh and shadow-detail reproduction, the contrast should be relatively low, but low contrast levels prove to be detrimental to obtaining good black densities. There is a simultaneous need for improved flesh tone reproductions, good blacks and sufficient shadow density.

It would accordingly be desirable to provide a color-coupled silver halide photographic print film element which would provide improved flesh and shadow-detail reproduction, while also enabling sufficiently high black densities and color saturation. It would be further desirable to provide such an element which may be used in current printers and processors to obtain such properties without requiring any modifications to standard exposure and development processes.

SUMMARY OF THE INVENTION

One embodiment of the invention comprises a silver halide light sensitive photographic print element comprising a support bearing on one side thereof: a blue color sensitive record comprising at least one blue-sensitive silver halide emulsion yellow-image forming layer, a red color sensitive record comprising at least one red-sensitive silver halide emulsion cyan-image forming layer, and a green color sensitive record comprising at least one green-sensitive silver halide emulsion magenta-image forming layer; wherein the overall contrast (OC) of the green record is greater than 1.7, preferably greater than or equal to 1.75, the mid-scale contrast (MSC) of the green record is less than 2.6, preferably less than 2.5, and the upper-scale contrast (USC) of the green record is from 2.85 to 3.15, preferably from 2.9 to 3.1, wherein the parameter OC for each of the color records is defined as the slope of a straight line connecting a point B and a point C on the characteristic curve of Equivalent Neutral Density versus log Exposure for the color record, where points B and C are located by defining a point A on the characteristic curve at the log Exposure required to attain a density level of 1.0, and points B and C are located on the characteristic curve at exposure values −1.1 log Exposure and +0.9 log Exposure with respect to point A, respectively, the parameter MSC is defined as the slope of a straight line connecting a point D and a point E on the characteristic curve for the color record, where points D and E are located at exposure values −0.2 log Exposure and +0.2 log Exposure with respect to point A, respectively, and the parameter USC is defined as the slope of a straight line connecting point E and point C.

A further embodiment of the invention comprises a process of forming an image in a motion picture silver halide light sensitive photographic print element as described above comprising exposing the silver halide light sensitive photographic print element to a color negative film record, and processing the exposed photographic print element to form a developed image having maximum green Equivalent Neutral Densities of at least 3.3, preferably at least 3.5. In accordance with preferred embodiments, the elements are exposed and processed to form images with red and blue maximum Equivalent Neutral Densities which are also at least 3.3, more preferably at least 3.5.

Preferably, the elements of the invention and the elements used in the process of the invention have corresponding red and blue OC and USC values which are at least 90% of the green values, and more preferably within ±10% of the green values, enabling the production of outstanding projected images having improved flesh tone reproduction and good black densities.

ADVANTAGES

We have found that color print film silver halide photographic elements in accordance with the invention enable the production of outstanding projected images having improved flesh tone and shadow detail reproduction, and sufficiently high black densities.

BRIEF DESCRIPTION OF THE DRAWING

FIG. 1 contains a Density versus Log Exposure plot for a standard 0–3 sensitometric exposure of a print film in accordance with the invention and illustrates how the parameters OC, MSC and USC are determined.

DETAILED DESCRIPTION OF THE INVENTION

The photographic print film elements of the present invention are color elements and contain dye image-forming units sensitive to each of the three primary regions of the spectrum, i.e. blue (about 400 to 500 nm), green (about 500 to 600 nm), and red (about 600 to 760 nm) sensitive image dye-forming units. Each unit can be comprised of a single emulsion layer or of multiple emulsion layers sensitive to a given region of the spectrum. The layers of the element, including the layers of the image-forming units, can be arranged in various orders as known in the art. In an alternative, less preferred, format, the emulsions sensitive to each of the three primary regions of the spectrum can be disposed as a single segmented layer.

A typical multicolor photographic print element comprises a support bearing a yellow dye image-forming unit comprising at least one blue-sensitive silver halide emulsion layer having associated therewith at least one yellow dye-forming coupler, a cyan dye image-forming unit comprised of at least one red-sensitive silver halide emulsion layer having associated therewith at least one cyan dye-forming coupler, and a magenta dye image-forming unit comprising at least one green-sensitive silver halide emulsion layer having associated therewith at least one magenta dye-forming coupler. Each of the cyan, magenta, and yellow image forming units may be comprised of a single light-sensitive layer, a pack of two light-sensitive layers with one being more light sensitive and the other being less light-sensitive, or a pack of three or more light-sensitive layers of varying light-sensitivity. These layers can be combined in any order depending upon the specific features designed in the photographic element. The element can contain additional layers, such as filter layers, interlayers, overcoat layers, subbing layers, antihalation layers, antistatic layers, and the like.

We have found that by designing films with relatively low mid-scale contrast (MSC) values below those of conventional color print films, in combination with relatively high upper-scale contrast (USC) values which together provides sufficiently high overall contrast (OC), we obtain benefits previously not available. Sufficiently high maximum densities are obtainable, while the low mid-scale contrasts result in print stocks which provide improved flesh tone reproductions in projected prints when used in conjunction with conventionally exposed color negative films.

The parameter OC for each of the color records of a print element is determined by locating the log exposure value associated with 1.0 Equivalent Neutral Density on the characteristic curve (point A on the curve, corresponding to a normally exposed 18% gray card) for the record and establishing a point B on the curve, 1.1 log E lower in value and a point C on the curve, 0.9 log E higher in exposure. This log E range corresponds to a 2.0 printing density range. OC is the two point contrast line BC. The mid-scale contrast value, MSC, assesses the suitability of the stock for reproducing mid-scale tones such as flesh tones, and is determined by establishing a point D on the curve, 0.2 log E lower in value than point A, and a point F on the curve, 0.2 log E higher in exposure than point A. MSC is simply the two point contrast line DE. Points D and E approximate the print densities for grays 1-stop above and below a normally exposed 18% gray. The upper-scale contrast value, USC is the two point contrast line EC, and in combination with the OC and MSC values determines the suitability of the stock for producing desirably high maximum densities.

In constructing films according to the invention, the required parameters can be achieved by various techniques, examples of which are described below. In accordance with the invention, the required parameters are specifically for the green color record, as the human eye extracts the highest proportion of image information from the green portion of the spectrum. These techniques may also be applied to the other color records of a silver halide photographic element so that multiple color records may meet the requirements of the present invention. For example, the contrast position exhibited in films according to the invention may be accomplished by any combination of formulations changes such as modified laydowns of silver or image coupler, blend ratio changes of high and low speed emulsions, modified laydowns of image modifying chemistry such as development inhibitor releasing (DIR) or development inhibitor anchimeric releasing (DIAR) couplers, and blend ratio changes of more-active and less-active image couplers. All of these film design tools are well known in the art. In the following discussion of suitable materials for use in the emulsions and elements that can be used in conjunction with the invention, reference will be made to *Research Disclosure,* September 1994, Item 36544, available as described above, which will be identified hereafter by the term "*Research Disclosure.*" The contents of the *Research Disclosure,* including the patents and publications referenced therein, are incorporated herein by reference, and the Sections hereafter referred to are Sections of the *Research Disclosure,* Item 36544.

The silver halide emulsions employed in the elements of this invention will be negative-working emulsions. Suitable silver halide emulsions and their preparation as well as methods of chemical and spectral sensitization are described in Sections I, and III–IV. Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described, for example, in Sections VI–IX. Layers and layer arrangements, color negative and color positive features, scan facilitating features, supports, exposure and processing conditions can be found in Sections XI–XX.

It is also contemplated that the materials and processes described in an article titled "Typical and Preferred Color Paper, Color Negative, and Color Reversal Photographic Elements and Processing," published in *Research Disclosure,* February 1995, Item 37038 also may be advantageously used with elements of the invention. It is further specifically contemplated that the print elements of the invention may comprise antihalation and antistatic layers and associated compositions as set forth in U.S. Pat. Nos. 5,650,265, 5,679,505, and 5,723,272, the disclosures of which are incorporated by reference herein.

Photographic light-sensitive print elements of the invention may utilize silver halide emulsion image forming layers wherein chloride, bromide and/or iodide are present alone or as mixtures or combinations of at least two halides. The combinations significantly influence the performance characteristics of the silver halide emulsion. Print elements are typically distinguished from camera negative elements by the use of high chloride (e.g., greater than 50 mole % chloride) silver halide emulsions containing no or only a minor amount of bromide (typically 10 to 40 mole %), which are also typically substantially free of iodide. As explained in Atwell, U.S. Pat. No. 4,269,927, silver halide with a high chloride content possesses a number of highly advantageous characteristics. For example, high chloride silver halides are more soluble than high bromide silver halide, thereby permitting development to be achieved in shorter times. Furthermore, the release of chloride into the developing solution has less restraining action on development compared to bromide and iodide and this allows developing solutions to be utilized in a manner that reduces the amount of waste developing solution. Since print films are intended to be exposed by a controlled light source, the imaging speed gain which would be associated with high bromide emulsions and/or iodide incorporation offers little benefit for such print films.

Photographic print elements are also distinguished from camera negative elements in that print elements typically comprise only fine silver halide emulsions comprising grains having an average equivalent circular diameter (ECD) of less than about 1 micron, where the ECD of a grain is the diameter of a circle having the area equal to the projected area of a grain. The ECDs of silver halide emulsion grains are usually less than 0.60 micron in red and green sensitized layers and less than 1.0 micron in blue sensitized layers of a color photographic print element. Such fine grain emulsions used in print elements generally have an aspect ratio of less than 1.3, where the aspect ratio is the ratio of a grain's ECD to its thickness, although higher aspect ratio grains may also be used. Such grains may take any regular shapes, such as cubic, octahedral or cubo-octahedral (i.e., tetradecahedral) grains, or the grains can take other shapes attributable to ripening, twinning, screw dislocations, etc. Typically, print element emulsions grains are bounded primarily by {100} crystal faces, since {100} silver chloride grain faces are exceptionally stable. Specific examples of high chloride emulsions used for preparing photographic prints are provided in U.S. Pat. Nos. 4,865,962; 5,252,454; and 5,252,456, the disclosures of which are here incorporated by reference.

In accordance with a preferred embodiment of the invention, photographic print films with color records having OC values of greater than 1.7, unusually low MSC values, and USC values which are significantly greater than MSC values may most conveniently be obtained by employing combinations of at least three distinct emulsions (i.e., a fast, a mid, and a slow emulsion) in the relevant color record. To enable such non-standard curve shapes, emulsions having speed separations of at least 0.2 log E, more preferably at least 0.3 log E, and most preferably about 0.5 log E between the fast and mid emulsions and also between the mid and slow emulsions are desirably used in each color record. The required speed separation for each component is dictated by its inherent exposure latitude. Even substantially monodispersed emulsions possess a finite grain size distribution around a mean grain size. This grain size distribution results in a finite exposure latitude. The larger this distribution the larger the exposure latitude. In practice one would use the exposure latitude of each component to build the desired overall contrast and exposure latitude of the composite blend. In this invention the maximum exposure latitude of each emulsion component can be equal to or less than the exposure latitude of the composite blend. This can only occur at minimum speed separation. As the speed separation of each component increases the exposure latitude of each component must decrease in order to build the desired composite curve shape and contrast. At maximum speed separation, the exposure latitude of each component must be such that the toe and threshold speeds appropriately overlap. Theoretically, this means that the minimum exposure latitude that each component may possess is one-third of the blended composite. However, a variety of speed separations and exposure latitudes for each component within these limits could be used to obtain color records having OC, MSC and USC values in accordance with the invention, depending on the amounts used in the composite blend.

The use of blended emulsions in a color photographic system is itself not new or novel. For example, to obtain wider exposure latitude in color negative film, U.S. Pat. No. 3,849,138 describes combining emulsions of different sensitivity but equal slopes (contrast) in separate layers. U.S. Pat. No. 4,745,047 describes the use of blended emulsions of different grain sizes in a color paper format to maintain gradation (contrast) in high density areas when benzyl alcohol is removed from the development process. U.S. Pat. No. 5,512,103 describes the use of blended emulsions of different contrasts in a color paper format to provide improved high density contrast and low density colors.

Emulsion blending may also be combined with use of pre-formed dyes or pigments to provide a uniform minimum density increase to obtain the lower midscale contrast and combination of contrast parameters in accordance with the invention. Additionally, dopants (any grain occlusions other than silver and halide ions) can be included in the silver halide grains of the blended emulsion to modify grain structure and emulsion properties. Periods 3–7 ions, including Group VIII metal ions (Fe, Co, Ni and platinum metals (pm) Ru, Rh, Pd, Re, Os, Ir and Pt), Mg, Al, Ca, Sc, Ti, V, Cr, Mn, Cu Zn, Ga, As, Se, Sr, Y, Mo, Zr, Nb, Cd, In, Sn, Sb, Ba, La, W, Au, Hg, Tl, Pb, Bi, Ce and U, e.g., can be introduced during emulsion grain precipitation. The dopants can be employed (a) to increase the sensitivity of the emulsions, (b) to reduce high or low intensity reciprocity failure, (c) to increase or reduce the variation of contrast, (d) to reduce pressure sensitivity, (e) to decrease dye desensitization, (f) to increase stability, (g) to reduce minimum density, (h) to increase maximum density, (i) to improve room light handling and (j) to enhance latent image formation in response to shorter wavelength (e.g. X-ray or gamma radiation) exposures. For some uses any polyvalent metal ion (pvmi) is effective. The selection of the host grain and the dopant, including its concentration and, for some uses, its location within the host grain and/or its valence can be varied to achieve aim photographic properties. To achieve the appropriate upper scale contrast and resulting maximum densities in accordance with the invention, it is specifically contemplated to employ desensitizing or contrast increasing ions or complexes as dopants in any or all of the emulsions used. Contrast increasing dopants are typically dopants which function to trap photogenerated holes or electrons by introducing additional energy levels deep within the bandgap of the host material. Examples include, but are not limited to, simple salts and complexes of Groups 8–10 transition metals (e.g., rhodium, iridium, cobalt, ruthenium, and osmium), and transition metal complexes containing nitrosyl or thionitrosyl ligands as described by McDugle et al U.S. Pat. No. 4,933,272. Specific examples include $K_3RhCl_6$, $(NH_4)_2Rh(Cl_5)H_2O$, $K_2IrCl_6$, $K_3IrCl_6$, $K_2IrBr_6$, $K_3IrBr_6$, $K_2ruCl_6$, $K_2Ru(NO)Br_5$, $K_2Ru(NS)Br_5$, $K_2OsCl_6$, $Cs_2Os(NO)Cl_5$, and $K_2Os(NS)Cl_5$. A oxalate, and organic ligand complexes of these or other metals as disclosed in U.S. Pat. No. 5,360,712 are also specifically contemplated.

Photographic print films which comprise relatively small grain, high chloride emulsions (e.g., emulsions having average grain size equivalent circular diameters of less than about 1 micron and halide contents of greater than 50 mole % chloride) as discussed above in order to optimize print image quality and enable rapid processing typically result in relatively low speed photographic elements in comparison to camera negative origination films. Low speed is compensated for by the use of relatively high intensity print lamps or lasers for exposing such print elements. For comparison purposes, it is noted that motion picture color print films, e.g., when rated using the same international standards criteria used for rating camera negative films, would typically have an ISO speed rating of less than 10, which is several stops slower than the slowest camera negative films in current use.

Couplers that may be used in the elements of the invention can be defined as being 4-equivalent or 2-equivalent depending on the number of atoms of $Ag^+$ required to form one molecule of dye. A 4-equivalent coupler can generally be converted into a 2-equivalent coupler by replacing a hydrogen at the coupling site with a different coupling-off group. Coupling-off groups are well known in the art. Such groups can modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, alkylthio (such as mercaptopropionic acid), arylthio, phosphonyloxy and arylazo. These coupling-off groups are described in the art, for example, in U.S. Pat. Nos. 2,455,169; 3,227,551; 3,432,521; 3,476,563; 3,617,291; 3,880,661; 4,052,212 and 4,134,766; and in U.K. Patents and published Application Nos. 1,466,728; 1,531,927; 1,533,039; 2,006,755A and 2,017,704A, the disclosures of which are incorporated herein by reference.

Image dye-forming couplers may be included in elements of the invention such as couplers that form cyan dyes upon reaction with oxidized color developing agents which are described in such representative patents and publications as: U.S. Pat. Nos. 2,367,531; 2,423,730; 2,474,293; 2,772,162; 2,895,826; 3,002,836; 3,034,892; 3,041,236; 4,883,746 and "Farbkuppler—Eine Literature Ubersicht," published in Agfa Mitteilungen, Band III, pp. 156–175 (1961). Preferably such couplers are phenols and naphthols that form cyan dyes on reaction with oxidized color developing agent. Also preferable are the cyan couplers described in, for instance, European Patent Application Nos. 544,322; 556,700; 556,777; 565,096; 570,006; and 574,948.

Couplers that form magenta dyes upon reaction with oxidized color developing agent which can be incorporated in elements of the invention are described in such representative patents and publications as: U.S. Pat. Nos. 2,600,788; 2,369,489; 2,343,703; 2,311,082; 2,908,573; 3,062,653; 3,152,896; 3,519,429 and "Farbkuppler—Eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents. Especially preferred couplers are 1H-pyrazolo [5,1-c]-1,2,4-triazole and 1H-pyrazolo [1,5-b]-1,2,4-triazole. Examples of 1H-pyrazolo [5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo [1,5-b]-1,2,4-triazoles can be found in European Patent Applications 176,804; 177,765; U.S. Pat. Nos. 4,659,652; 5,066,575; and 5,250,400.

Couplers that form yellow dyes upon reaction with oxidized color developing agent and which are useful in elements of the invention are described in such representative patents and publications as: U.S. Pat. Nos. 2,875,057; 2,407,210; 3,265,506; 2,298,443; 3,048,194; 3,447,928 and "Farbkuppler—Eine Literature Ubersicht," published in Agfa Mitteilungen, Band III, pp. 112–126 (1961). Such couplers are typically open chain ketomethylene compounds. Also preferred are yellow couplers such as described in, for example, European Patent Application Nos. 482,552; 510,535; 524,540; 543,367; and U.S. Pat. No. 5,238,803.

To control the migration of various components coated in a photographic layer, including couplers, it may be desirable to include a high molecular weight hydrophobe or "ballast" group in the component molecule. Representative ballast groups include substituted or unsubstituted alkyl or aryl groups containing 8 to 40 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido (also known as acylamino), carbamoyl, alkylsulfonyl, arysulfonyl, sulfonamido, and sulfamoyl groups wherein the substituents typically contain 1 to 40 carbon atoms. Such substituents can also be further substituted. Alternatively, the molecule can be made immobile by attachment to a polymeric backbone.

It may be useful to use a combination of couplers any of which may contain known ballasts or coupling-off groups such as those described in U.S. Pat. Nos. 4,301,235; 4,853,319 and 4,351,897.

If desired, the photographic elements of the invention can be used in conjunction with an applied magnetic layer as described in *Research Disclosure,* November 1992, Item 34390 published by Kenneth Mason Publications, Ltd., Dudley House, 12 North Street, Emsworth, Hampshire P010 7DQ, ENGLAND.

Photographic elements of the present invention are motion picture print film elements. Such elements typically have a width of up to 100 millimeters (or only up to 70 or 50 millimeters), and a length of at least 30 meters (or optionally at least 100 or 200 meters). In motion picture printing, there are usually three records to record in the image area frame region of a print film, i.e., red, green and blue. The original record to be reproduced is preferably an image composed of sub-records having radiation patterns in different regions of the spectrum. Typically it will be a multicolor record composed of sub-records formed from cyan, magenta and yellow dyes. The principles by which such materials form a color image are described in James, The Theory of the Photographic Process, Chapter 12, Principles and Chemistry of Color Photography, pp 335–372, 1977, Macmillan Publishing Co. New York. Materials in which such images are formed can be exposed to an original scene in a camera, or can be duplicates formed from such camera origination materials, e.g., records formed in color negative intermediate films such as those identified by the tradenames Eastman Color Intermediate Films 2244, 5244 and 7244. Alternatively, the original record may be in the form of electronic image data, which may be used to control a printer apparatus, such as a laser printer, for selective imagewise exposure of a print film in accordance with the invention.

In accordance with the process of the invention, print films may be exposed under normal printing conditions which may be indicated with the film or other manufacturer recommendations, and processed according to standard processing conditions indicated with the film or its packaging. This is advantageous in that the film user need not experiment with various development or print exposing conditions in order to obtain a desired contrast position. The film of the present invention is preferably simply printed and processed according to standard procedures, and the advantages of the film are obtained. Alternative processing techniques, however, can also be used with films according to the invention if desired.

By "indicated" in relation to the film printing and processing conditions, means that some designation is provided on the film or its packaging or associated with one or the other, which allows the user to ascertain the manufacturer's recommended printing and/or film processing conditions. Such a designation can be an actual statement of the recommended printing or processing conditions or reference to a well-known standard method (for example, the Kodak ECP-2B process for motion picture print films). Alternatively, such a designation can be a film identification designation (such as a number or film name) which allows a user to match the film with the manufacturer's recommended printing or processing conditions (such as from a catalogue, brochure or other source).

The following examples illustrate preparation of photographic elements of the present invention, and their beneficial characteristics.

EXAMPLE 1

A comparison multilayer photographic print element (Element 101) having conventional MSC and OC values in accordance with prior art practice was prepared by coating the following layers as described below on a gelatin subbed polyethylene terephthalate support. The support was coated on the backside with a vanadium pentoxide antistatic backing layer overcoated with a polyurethane layer similarly as described in U.S. Pat. No. 5,679,505.

A second comparison multilayer photographic print element (Element 102) was also prepared having conventional MSC and relatively high OC and USC values in accordance with U.S. Pat. No. 5,888,706.

A third comparison multilayer photographic print element (Element 103) having lower MSC, USC and OC values, and an inventive multilayer photographic print element (Element 104) having low MSC but relatively high USC and OC values were made similarly as element 101, but with changes in the amount of the emulsions and couplers and the incorporation of cyan, magenta, and yellow pre-formed dyes.

A second inventive multilayer photographic print element (Element 105) also having low MSC but relatively high USC and OC values was similarly made, employing preformed dyes and emulsions containing the contrast enhancing dopant $Cs_2OsNOCl_5$.

All units unless otherwise specified are in mg/m$^2$:

TABLE 1

Descriptions of Element 101–104.

| | 101 | 102 | 103 | 104 |
|---|---|---|---|---|
| Protective Overcoat | | | | |
| Gelatin | 907 | 907 | 907 | 907 |
| Polydimethylsiloxane lubricant (Dow Corning) | 16 | 16 | 16 | 16 |
| Polymethylmethacrylate beads | 16 | 16 | 16 | 16 |
| Spreading Aids | | | | |
| Green Emulsion Layer | | | | |
| AgClBr cubic grain emulsion, 1.35% Br, 0.14 micron, spectrally sensitized with green sensitizing dye GSD-1, 0.363 mmole/Ag mole, and green sensitizing dye GSD-2, 0.012 mmole/Ag mole. | 73.5 | 427 | 145.5 | 189 |
| AgClBr cubic grain emulsion, 1.2% Br, 0.18 micron, spectrally sensitized with green sensitizing dye GSD-1, 0.293 mmole/Ag mole, and green sensitizing dye GSD-2, 0.009 mmole/Ag mole. | 343 | 158 | 257 | 307 |
| AgClBr cubic grain emulsion, 1.7% Br, 0.26 micron, spectrally sensitized with green sensitizing dye GSD-1, 0.273 mmole/Ag mole, and green sensitizing dye GSD-2, 0.008 mmole/Ag mole. | 73.5 | 103 | 82.5 | 292 |
| Magenta Dye Forming Coupler M-1 | 657 | 860 | 634 | 667 |
| Green Filter Dye GFD-1 | 14 | 22 | 14 | 14.4 |
| Green Filter Dye GFD-2 | 32 | 28 | 23 | 29 |
| Oxidized Developer Scavenger Scav-1 | 12 | 30 | 5 | 5 |
| Gelatin | 1507 | 2045 | 1507 | 1453 |
| Interlayer | | | | |
| Cyan Preformed Dye CPD-1 | 0 | 0 | 19 | 12 |
| Magenta Preformed Dye MPD-1 | 0 | 0 | 14 | 11 |
| Yellow Preformed Dye YPD-1 | 0 | 0 | 24 | 24 |
| Oxidized Developer Scavenger Scav-1 | 86 | 86 | 86 | 86 |
| Gelatin | 610 | 610 | 610 | 610 |
| Spreading aids | | | | |

TABLE 1-continued

Descriptions of Element 101–104.

| | 101 | 102 | 103 | 104 |
|---|---|---|---|---|
| Red Emulsion Layer | | | | |
| AgClBr cubic grain emulsion, 0.8% Br, 0.14 micron, spectrally sensitized with red sensitizing dye RSD-1, 0.042 mmole/Ag mole. | 117.5 | 359 | 178 | 196.5 |
| AgClBr cubic grain emulsion, 0.9% Br, 0.18 micron, spectrally sensitized with red sensitizing dye RSD-1, 0.044 mmole/Ag mole. | 218.5 | 180.5 | 182.5 | 198.5 |
| AgClBr cubic grain emulsion, 0.9% Br, 0.26 micron, spectrally sensitized with red sensitizing dye RSD-1, 0.050 mmole/Ag mole. | 70 | 93.5 | 84.5 | 92 |
| Cyan dye forming coupler C-1 | 888 | 1125 | 880 | 888 |
| Red Absorber Dye Pina | | | | 48.5 |
| TM Filter Blue | | | | |
| Green (Riedel-de Haen Company) | 68 | 84 | 49 | |
| Gelatin | 3122 | 4198 | 3122 | 3024 |
| Interlayer | | | | |
| Oxidized Developer Scavenger Scav-1 | 86 | 86 | 86 | 86 |
| Gelatin | 610 | 610 | 610 | 610 |
| Spreading Aids | | | | |
| Blue Emulsion Layer | | | | |
| AgClBr cubic grain emulsion, 0.4% Br, 0.40 micron, spectrally sensitized with blue sensitizing dye BSD-1, 0.151 mmole/Ag mole and blue sensitizing dye BSD-2, 0.149 mmole/Ag mole. | 259 | 409.5 | 290.5 | 292 |
| AgClBr cubic grain emulsion, 0.5% Br, 0.50 micron, spectrally sensitized with blue sensitizing dye BSD-1, 0.219 mmole/Ag mole and blue sensitizing dye BSD-2, 0.217 mmole/Ag mole. | 370 | 420 | 286.5 | 307 |
| AgClBr cubic grain emulsion, 0.3% Br, 0.90 micron, spectrally sensitized with blue sensitizing dye BSD-1, 0.124 mmole/Ag mole and blue sensitizing dye BSD-2, 0.122 mmole/Ag mole. | 167 | 220.5 | 149 | 189 |
| Yellow Coupler (Y-1) | 1290 | 1722 | 1270 | 1315 |
| Blue filter dye BFD-1 | 31 | 47 | 15 | 25.3 |
| Metal Ion Sequestrant Seq-1 | 43 | 43 | 43 | 43 |
| Metal Ion Sequestrant Seq-2 | 22 | 22 | 22 | 22 |
| Yellow Preformed Dye YPD-1 | 8 | 4 | 0 | 0 |
| Gelatin | 2476 | 3040 | 2476 | 2442 |
| Antihalation Layer | | | | |
| Antihalation Filter Dye AFD-1 | 53 | 53 | 53 | 53 |
| Antihalation Filter Dye AFD-2 | 120 | 120 | 120 | 120 |
| Gelatin | 700 | 700 | 700 | 700 |
| Spreading aids | | | | |
| Support | | | | |
| Transparent polyethylene terephthalate support with polyurethane overcoated vanadium pentoxide antistatic layer on the back of the film base which provides process surviving antistatic properties | | | | |

TABLE 2

| Description of Element 105. | |
|---|---|
| Protective Overcoat | |
| Gelatin | 907 |
| Polydimethylsiloxane lubricant (Dow Corning) | 16 |
| Polymethylmethacrylate beads | 16 |
| Spreading Aids | |
| Green Emulsion Layer | |
| AgClBr cubic grain emulsion, 1.35% Br, 0.18 micron, containing a contrast enhancing compound ($Cs_2OsNOCl_5$), $1.5 \times 10^{-4}$ mmole/Ag mole, spectrally sensitized with green sensitizing dye GSD-1, 0.413 mmole/Ag mole, and green sensitizingdye GSD-2, 0.009 mmole/Ag mole. | 218 |
| AgClBr cubic grain emulsion, 1.2% Br, 0.18 micron, spectrally sensitized with green sensitizing dye GSD-1, 0.293 mmole/Ag mole, and green sensitizing dye GSD-2, 0.009 mmole/Ag mole. | 198 |
| AgClBr cubic grain emulsion, 1.7% Br, 0.26 micron, spectrally sensitized with green sensitizing dye GSD-1, 0.273 mmole/Ag mole, and green sensitizing dye GSD-2, 0.008 mmole/Ag mole. | 68 |
| Magenta Dye Forming Coupler M-1 | 710 |
| Green Filter Dye GFD-1 | 16 |
| Green Filter Dye GFD-2 | 16 |
| Oxidized Developer Scavenger Scav-1 | 11 |
| Gelatin | 1507 |
| Interlayer | |
| Oxidized Developer Scavenger Scav-1 | 86 |
| Gelatin | 610 |
| Spreading aids | |
| Red Emulsion Layer | |
| AgClBr cubic grain emulsion, 1.2% Br, 0.18 micron, containing a contrast enhancing compound ($Cs_2OsNOCl_5$), $1.5 \times 10^{-4}$ mmole/Ag mole, spectrally sensitized with red sensitizing dye RSD-1, 0.0592 mmole/Ag mole. | 218 |
| AgClBr cubic grain emulsion, 0.8% Br, 0.18 micron, spectrally sensitized with red sensitizing dye RSD-1, 0.038 mmole/Ag mole. | 170.5 |
| AgClBr cubic grain emulsion, 0.9% Br, 0.26 micron, spectrally sensitized with red sensitizing dye RSD-1, 0.050 mmole/Ag mole. | 85.5 |
| Cyan dye forming coupler C-1 | 883 |
| Cyan Preformed Dye CPD-1 | 12 |
| Magenta Preformed Dye MPD-1 | 11 |
| Yellow Preformed Dye YPD-1 | 24 |
| Red Absorber Dye Pina TM Filter Blue Green (Riedel-de Haen Company) | 65 |
| Gelatin | 3122 |
| Interlayer | |
| Oxidized Developer Scavenger Scav-1 | 86 |
| Gelatin | 610 |
| Spreading Aids | |
| Blue Emulsion Layer | |
| AgClBr cubic grain emulsion, 0.4% Br, 0.40 micron, spectrally sensitized with blue sensitizing dye BSD-1, 0.151 mmole/Ag mole and blue sensitizing dye BSD-2, 0.149 mmole/Ag mole. | 301 |
| AgClBr cubic grain emulsion, 0.5% Br, 0.50 micron, spectrally sensitized with blue sensitizing dye BSD-1, 0.219 mmole/Ag mole and blue sensitizing dye BSD-2, 0.217 mmole/Ag mole. | 332.5 |
| AgClBr cubic grain emulsion, 0.3% Br, 0.90 micron, spectrally sensitized with blue sensitizing dye BSD-1, 0.124 mmole/Ag mole and blue sensitizing dye BSD-2, 0.122 mmole/Ag mole. | 158.5 |
| Yellow Coupler (Y-1) | 1292 |
| Blue filter dye BFD-1 | 22 |
| Metal Ion Sequestrant Seq-1 | 43 |
| Metal Ion Sequestrant Seq-2 | 22 |
| Gelatin | 2476 |
| Antihalation Layer | |
| Antihalation Filter Dye AFD-1 | 53 |
| Antihalation Filter Dye AFD-2 | 120 |
| Gelatin | 700 |
| Spreading aids | |
| Support | |
| Transparent polyethylene terephthalate support with polyurethane overcoated vanadium pentoxide antistatic layer on the back of the film base which provides process surviving antistatic properties | |

Each element also contained bis-vinylsulfonylmethane (BVSM) as a gelatin hardener. Couplers were dispersed with high-boiling coupler solvents and/or auxiliary solvents in accordance with conventional practice in the art.

Elements 101–105, as well as a uniformly pre-exposed "flashed" sample of Element 101 (Element 101F), were exposed through a 0–3 density 21-step tablet on a Kodak 1B sensitometer with a 3200 K light source, and processed according to the standard Kodak ECP-2B Color Print Development Process as described in the Kodak H-24 Manual, "Manual for Processing Eastman Motion Picture Films", Eastman Kodak Company, Rochester, N.Y., the disclosure of which is incorporated by reference herein, with the exception that those steps specific to sound track development were omitted. Exposures were adjusted so that upon standard processing a middle (e.g., 11th) step achieved Red, Green, Blue Equivalent Neutral Density of 1.0, 1.0, 1.0. The process consisted of a prebath (10"), water rinse (20"), color developer (3'), stop bath (40"), first wash (40"), first fix (40"), second wash (40"), bleach (1'), third wash (40"), second fix (40"), fourth wash (1'), final rinse (10"), and then drying with hot air.

| The ECP-2B Prebath consists of | |
|---|---|
| Water | 800 mL |
| Borax (decahydrate) | 20.0 g |
| Sodium sulfate (anhydrous) | 100.0 g |
| Sodium hydroxide | 1.0 g |
| Water to make 1 liter | |
| pH @ 26.7° C. is 9.25 +/− 0.10 | |
| The ECP-2B Color Developer consists of | |
| Water | 900 mL |
| Kodak Anti-Calcium, No. 4 (40% solution of a pentasodium salt of nitrilo-tri(methylene phosphonic acid) | 1.00 mL |
| Sodium sulfite (anhydrous) | 4.35 g |
| Sodium bromide (anhydrous) | 1.72 g |
| Sodium carbonate (anhydrous) | 17.1 g |
| Kodak Color Developing Agent, CD-2 | 2.95 g |
| Sulfuric acid (7.0 N) | 0.62 mL |
| Water to make 1 liter | |
| pH @ 26.7° C. is 10.53 +/− 0.05 | |
| The ECP-2B Stop Bath consists of | |
| Water | 900 mL |
| Sulfuric acid (7.0 N) | 50 mL |

-continued

| | |
|---|---|
| Water to make 1 liter | |
| pH @ 26.7° C. is 0.90 | |
| The ECP-2B Fixer consists of | |
| Water | 800 mL |
| Ammonium thiosulfate (58.0% solution) | 100.0 mL |
| Sodium bisulfate (anhydrous) | 13.0 g |
| Water to make 1 liter | |
| pH @ 26.7° C. is 5.00 +/− 0.15 | |

-continued

| | |
|---|---|
| The ECP-2B Ferricyanide Bleach consists of | |
| Water | 900 mL |
| Potassium ferricyanide | 30.0 g |
| Sodium bromide (anhydrous) | 17.0 g |
| Water to make 1 liter | |
| pH @ 26.7° C. is 6.50 +/− 0.05 | |
| The Final Rinse solution consists of | |
| Water | 900 mL |
| Kodak Photo-Flo 200 (TM) Solution | 3.0 mL |
| Water to make 1 liter | |

Processing of the exposed elements was done with the color developing solution adjusted to 36.7° C. The stopping, fixing, bleaching, washing, and final rinsing solution temperatures were adjusted to 26.7° C.

The films were then read for Status A densitometry, and converted to equivalent neutral densitometry using the method as described in the article "Procedures for Equivalent-Neutral-Density (END) Calibration of Color Densitometers Using a Digital Computer", by Albert J. Sant, in the Photographic Science and Engineering, Vol. 14, Number 5, September–October 1970, pg. 356–362. The Equivalent Neutral Densities were graphed vs. log (exposure) to form Red, Green, and Blue D-LogE characteristic curves for each of the Elements, and overall contrast (OC), mid-scale contrast (MSC) and upper-scale contrast (USC) values were determined for each color record.

Table 3 summarizes the contrast values of the print materials. The contrast is defined as OC=[(Equivalent Neutral Density at +0.9 log E END)−(Equivalent Neutral Density at −1.1 log E from 1.0 END)]/2.0 Log E. Mid-scale contrast is defined as MSC=[(Equivalent Neutral Density at 0.2 log E from 1.0 END)−(Equivalent Neutral Density at −0.2 log E from 1.0 END)]/0.4 Log E. Upper scale contrast is defined as USC=[(Equivalent Neutral Density at 0.9 log E from 1.0 END)−(Equivalent Neutral Density at +0.2 log E from 1.0 END)]/0.7 Log E. The Equivalent Neutral Density (END) for the $21^{st}$ stp of the 21 step exposure is also indicated for each color record in Table 4.

TABLE 3

| | Contrast Values | | | | | | | | |
|---|---|---|---|---|---|---|---|---|---|
| | MSC Values | | | USC Values | | | OC Values | | |
| Element | Red | Green | Blue | Red | Green | Blue | Red | Green | Blue |
| 101 (Comp.) | 3.32 | 2.69 | 2.85 | 2.63 | 2.67 | 2.80 | 1.80 | 1.71 | 1.76 |
| 102 (Comp.) | 3.24 | 2.70 | 2.89 | 3.90 | 3.91 | 4.12 | 2.23 | 2.14 | 2.25 |
| 103 (Comp.) | 3.22 | 2.58 | 2.60 | 2.50 | 2.58 | 2.74 | 1.73 | 1.65 | 1.66 |
| 104 (Inv.) | 2.87 | 2.47 | 2.56 | 2.91 | 2.92 | 2.98 | 1.80 | 1.74 | 1.75 |
| 105 (Inv.) | 2.88 | 2.48 | 2.50 | 2.84 | 3.04 | 3.07 | 1.80 | 1.81 | 1.78 |
| 101F* (Comp.) | 2.97 | 2.43 | 2.37 | 2.73 | 2.80 | 2.90 | 1.77 | 1.71 | 1.70 |

*"Flashed" Element 101F was made by exposing and processing a camera negative film to achieve a uniform 18% gray density level, and then printing the camera negative film onto a sample of Element 101 in a Bell and Howell panel printer with the following printer settings Speed: 480 fpm, Voltage: 90 volts, Filters 2B, 0.40 R, 0.50 G, 0.70 B, Trims 16, 10, 13 (R, G, B respectively). The timing tape values (3, 1, 2) were set to create red, green and blue densities of 0.02 over Dmin on Element 101.

TABLE 4

| | Dmax (Step 21) Values | | |
|---|---|---|---|
| Element | Red | Green | Blue |
| 101 | 3.81 | 3.72 | 3.82 |
| 102 | 4.85 | 4.97 | 4.86 |
| 103 | 3.64 | 3.68 | 3.71 |
| 104 | 3.80 | 3.72 | 3.82 |
| 105 | 3.82 | 3.79 | 3.86 |
| 101F | 3.78 | 3.74 | 3.77 |

The high USC and OC of Elements 101 and 102 make such films suitable to provide good black densities (especially Element 102), but the relatively high MSC values may also result in poorer than desired shadow detail and harsh flesh tones. The lower MSC value of Element 103 provides better flesh reproduction and good shadow detail, but the correspondingly low USC and OC values result in lower black densities and the film has insufficient latitude. The low MSC of Element 101F similarly provides good flesh reproduction, but the images resulting from such specially processed films often are evaluated as too "flat" and unacceptable to the industry. Elements 104 and 105 have low MSC values which provide a desirable improvement with respect to flesh tone reproductions. The USC and OC values of Elements 104 and 105 are high enough to provide good black densities similar to Element 101, and low enough to also provide good shadow detail in combination with acceptable latitude.

The following structures represent compounds utilized in the above described photographic elements.

Green sensitizing dye GSD-1
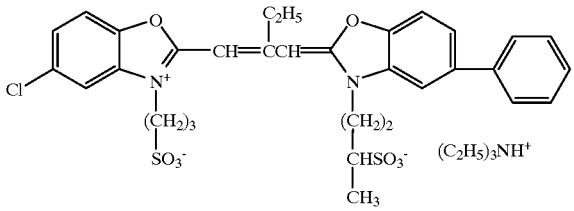
Green sensitizing dye GSD-2
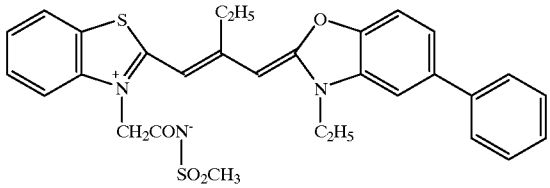
Magenta coupler M-1
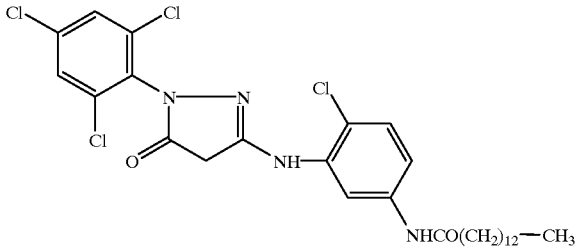
Green Filter Dye GFD-1
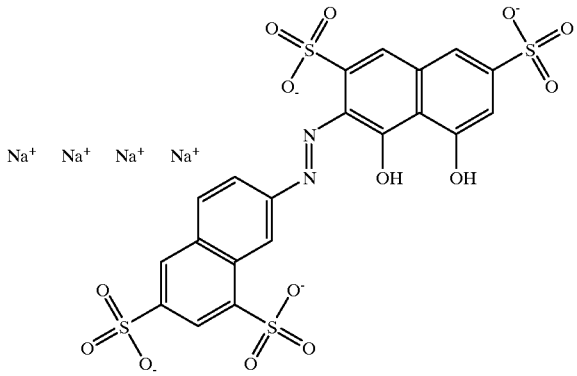
Green Filter Dye GFD-2
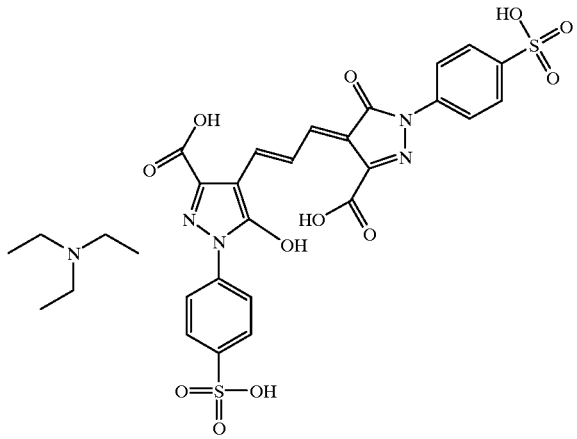

-continued
Scavenger
Scav-1
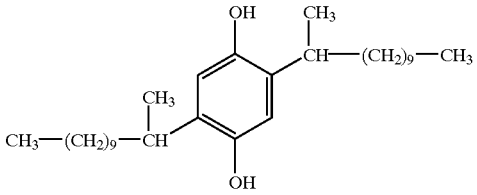
Cyan
Preformed
Dye CPD-1
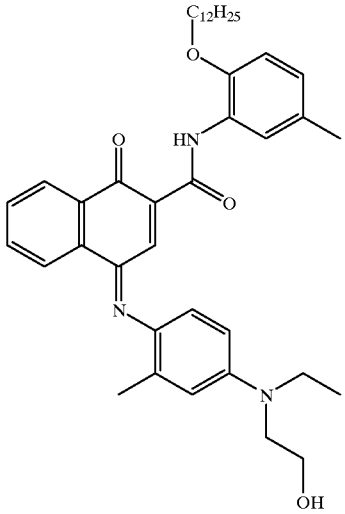
Magenta
Preformed
Dye MPD-1
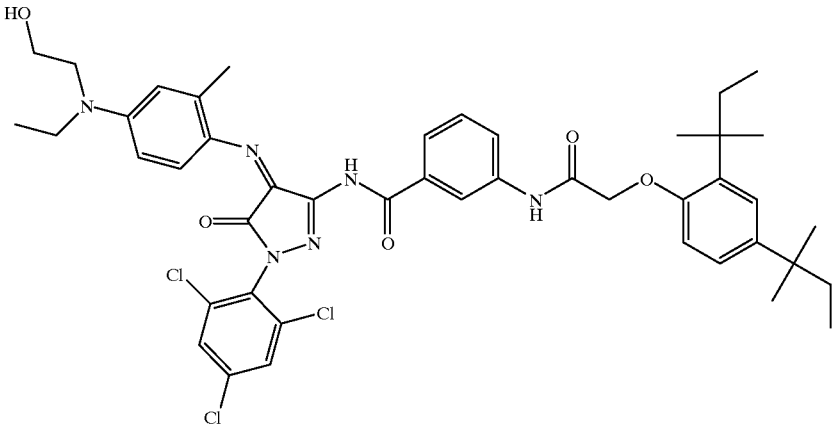
Yellow
Preformed
Dye YPD-1
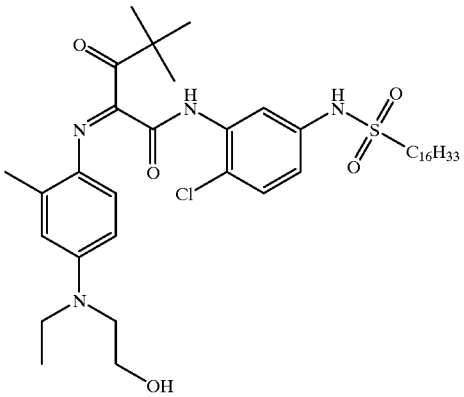

-continued
Red sensitizing dye RSD-1
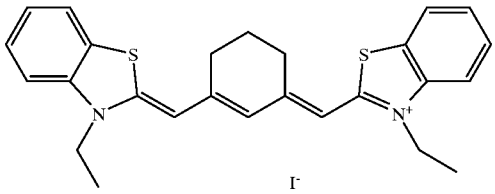
Cyan coupler C-1
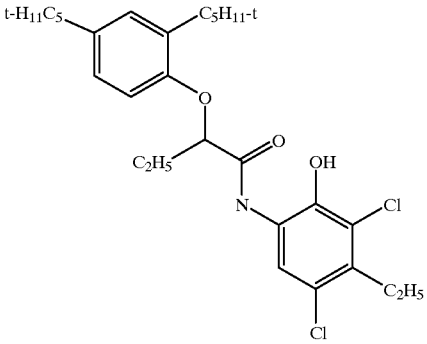
Blue sensitizing dye BSD-1
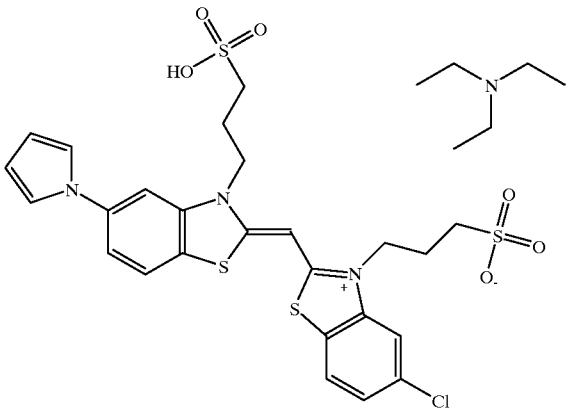
Blue sensitizing dye BSD-2
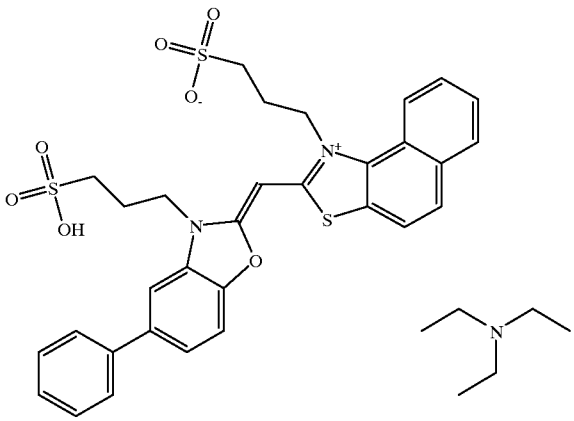

-continued
| | |
|---|---|
| Yellow coupler Y-1 | 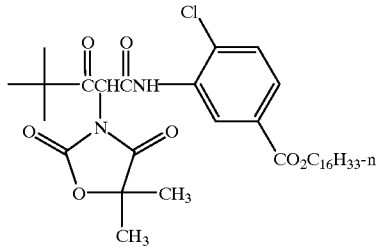 |
| Blue filter dye BFD-1 | 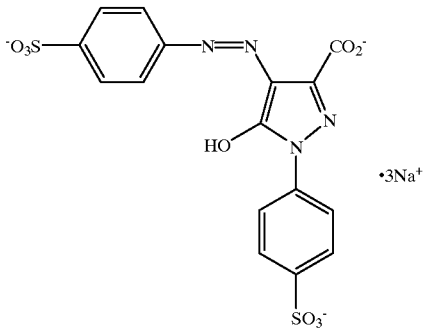 |
| Sequestrant Seq-1 | 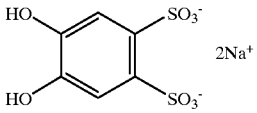 |
| Sequestrant Seq-2 | 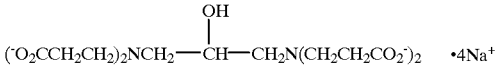 |
| Antihalation filter dye AFD-1 | 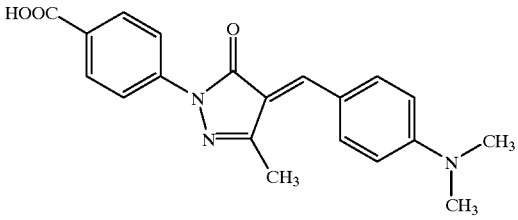 |
| Antihalation filter dye AFD-2 | 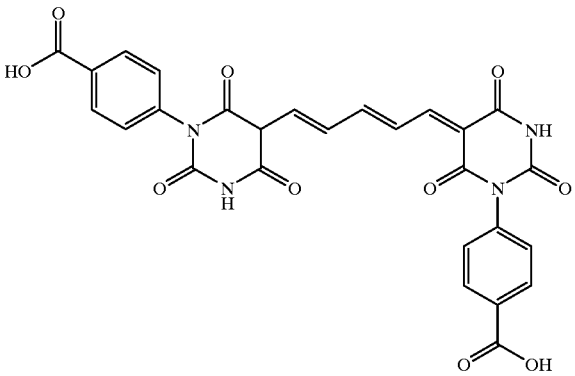 |

While the invention has been described in detail with particular reference to preferred embodiments, it will be understood that variations and modifications can be effected within the spirit and scope of the invention.

What is claimed is:

1. A silver halide light sensitive motion picture photographic print element comprising a support bearing on one side thereof: a blue color sensitive record comprising at least one blue-sensitive silver halide emulsion yellow-image forming layer, a red color sensitive record comprising at least one red-sensitive silver halide emulsion cyan-image forming layer, and a green color sensitive record comprising at least one green-sensitive silver halide emulsion magenta-image forming layer; wherein the overall contrast (OC) of the green record is greater than 1.7, the mid-scale contrast (MSC) of the green record is less than 2.6, and the upper-scale contrast (USC) of the green record is from 2.85 to 3.15, wherein the parameter OC for each of the color records is defined as the slope of a straight line connecting a point B and a point C on the characteristic curve of Equivalent Neutral Density versus log Exposure for the color record, where points B and C are located by defining a point A on the characteristic curve at the log Exposure required to attain a density level of 1.0, and points B and C are located on the characteristic curve at exposure values −1.1 log Exposure and +0.9 log Exposure with respect to point A, respectively, the parameter MSC is defined as the slope of a straight line connecting a point D and a point E on the characteristic curve for the color record, where points D and E are located at exposure values −0.2 log Exposure and +0.2 log Exposure with respect to point A, respectively, and the parameter USC is defined as the slope of a straight line connecting point E and point C.

2. A color photographic print element according to claim 1, wherein the green color record has an OC value greater than or equal to 1.75.

3. A color photographic print element according to claim 1 wherein the red and blue color records have OC values which are at least 90% of the green color record OC value.

4. A color photographic print element according to claim 1 wherein the red and blue color records have OC values within 10% of the green color record OC value.

5. A color photographic print element according to claim 1 wherein each of the red, green and blue color records has an OC value of at least 1.7.

6. A color photographic print element according to claim 1 wherein the green color record has a MSC value of less than 2.5.

7. A color photographic print element according to claim 6 wherein the green color record has an USC value of from 2.9 to 3.1.

8. A color photographic print element according to claim 1 wherein the green color record has an USC value of from 2.9 to 3.1.

9. A color photographic print element according to claim 1 wherein the red and blue color records have USC values which are at least 90% of the green color record USC value.

10. A color photographic print element according to claim 1 wherein the red and blue color records have USC values within 10% of the green color record USC value.

11. A color photographic print element according to claim 1, having an effective ISO speed rating of less than about 10.

12. A color photographic print element according to claim 1, wherein the silver halide of each of at least one of the blue-sensitive, red-sensitive, and green-sensitive silver halide emulsion layers comprises silver chloride emulsion grains or silver bromochloride emulsion grains comprising greater than 50 mole % chloride.

13. A color photographic print element according to claim 12, wherein the silver chloride emulsion grains and silver bromochloride emulsion grains of each layer have an average equivalent circular diameter of less than 1 micron and an aspect ratio of less than 1.3.

14. A color photographic print element according to claim 12, wherein each of the red-sensitive and green-sensitive silver halide emulsion layers comprise emulsion grains having an average equivalent circular diameter of less than 0.60 micron, and the blue-sensitive silver halide emulsion layer comprises emulsion grains having an average equivalent circular diameter of less than 1.0 micron.

15. A process of forming an image in a motion picture silver halide light sensitive photographic print element according to claim 1 comprising exposing the silver halide light sensitive photographic print element to a color negative film record, and processing the exposed photographic print element to form a developed image having maximum green Equivalent Neutral Densities of at least 3.5.

16. A process according to claim 15, wherein the green color record of the print element has an MSC value less than 2.5, and an USC value from 2.9 to 3.1.

17. A process according to claim 15 wherein the red and blue color records of the print element have OC values which are at least 90% of the green color record OC value.

18. A process according to claim 15 wherein the red and blue color records of the print element have OC values within 10% of the green color record OC value.

19. A process according to claim 15, wherein the print element is exposed and processed to form images with maximum red and blue Equivalent Neutral Densities which are at least 3.5.

* * * * *